US007059845B2

(12) United States Patent
Mazzanti et al.

(10) Patent No.: US 7,059,845 B2
(45) Date of Patent: Jun. 13, 2006

(54) MOULDING ELEMENT FOR FORMING ARTICLES BY SLIP CASTING WITH CLAY OR THE LIKE AND A METHOD FOR ITS MANUFACTURE

(75) Inventors: Vasco Mazzanti, Imola (IT); Paolo Figliano, Imola (IT)

(73) Assignee: Sacmi Cooperativa Meccanici Imola Societa Cooperativa, Imola (IT)

( * ) Notice: Subject to any disclaimer, the term of this patent is extended or adjusted under 35 U.S.C. 154(b) by 126 days.

(21) Appl. No.: 10/297,756

(22) PCT Filed: Feb. 26, 2002

(86) PCT No.: PCT/EP02/02303

§ 371 (c)(1),
(2), (4) Date: Dec. 9, 2002

(87) PCT Pub. No.: WO02/072327

PCT Pub. Date: Sep. 19, 2002

(65) Prior Publication Data

US 2003/0134005 A1 Jul. 17, 2003

(30) Foreign Application Priority Data

Mar. 9, 2001 (IT) ..... RE2001A0022

(51) Int. Cl.
*B28B 1/26* (2006.01)
*B28B 7/12* (2006.01)

(52) U.S. Cl. ..... 425/84; 425/85; 264/221; 264/87; 249/141; 249/61

(58) Field of Classification Search ..... 425/85, 425/84; 264/87, 221; 249/141, 61; B28B 1/26, B28B 7/12
See application file for complete search history.

(56) References Cited

U.S. PATENT DOCUMENTS

| | | | | |
|---|---|---|---|---|
| 3,156,751 | A | 11/1964 | Valdes et al. | |
| 3,243,860 | A * | 4/1966 | Whittaker et al. | 425/84 |
| 3,723,584 | A * | 3/1973 | Nussbaum | 264/46.6 |
| 4,531,705 | A | 7/1985 | Nakagawa et al. | |
| 4,808,360 | A * | 2/1989 | Natori et al. | 264/221 |
| 4,830,802 | A * | 5/1989 | Ito et al. | 264/135 |
| 4,874,304 | A * | 10/1989 | Ito et al. | 425/84 |
| 4,884,959 | A | 12/1989 | Ito et al. | |
| 5,020,983 | A * | 6/1991 | Ito et al. | 425/85 |
| 5,069,609 | A * | 12/1991 | Ito et al. | 425/84 |

(Continued)

FOREIGN PATENT DOCUMENTS

| | | |
|---|---|---|
| DE | 35 02 348 | 7/1986 |
| DE | 42 25 412 | 4/1993 |

*Primary Examiner*—Robert Davis
*Assistant Examiner*—G. Nagesh Rao
(74) *Attorney, Agent, or Firm*—Browdy and Neimark, PLLC

(57) ABSTRACT

The element has at least one porous permeable impression surface, on which the clay slip is deposited. A drainage system for the slip fluid is provided having a relatively thin, empty or porous chamber in the form of a slab which is incorporated into the body of the mould element itself, is disposed within the range of drainage action of the impression surface, and has a degree of porosity greater than the front part of the body delimited between said thin chamber and the impression surface, evacuation means connected to said thin chamber being provided to evacuate the drained fluid collected by the chamber. In particular, said thin chamber is disposed substantially parallel to the impression surface at a relatively short distance therefrom.

16 Claims, 3 Drawing Sheets

U.S. PATENT DOCUMENTS 5,156,856 A * 10/1992 Iwasaki et al. ..... 425/85
5,266,252 A * 11/1993 Buck et al. ..... 264/86
5,451,152 A * 9/1995 Funahashi et al. ..... 425/85
5,556,587 A * 9/1996 Funahashi et al. ..... 264/86
5,972,263 A * 10/1999 Goodman et al. ..... 264/86
6,024,787 A * 2/2000 Lee ..... 106/38.22
6,165,398 A * 12/2000 Matsumoto et al. ..... 264/87
6,375,880 B1 * 4/2002 Cooper et al. ..... 264/138

* cited by examiner

MOULDING ELEMENT FOR FORMING ARTICLES BY SLIP CASTING WITH CLAY OR THE LIKE AND A METHOD FOR ITS MANUFACTURE

This application is a 371 of PCT application EP 02/02303, filed Feb. 26, 2002.

TECHNICAL FIELD

This invention relates to a moulding element for forming articles (sanitary ware, crockery, etc.) by slip casting with clay or similar materials, and a method for its manufacture.

BACKGROUND ART

The process of forming articles by clay slip casting is a very old process which is still used to form numerous articles, in particular substantially all ceramic sanitary articles of complex shape with hidden surfaces, and is ideal for forming such shapes.

This process is based on the fact that the mould comprises impression surfaces, formed with porous permeable material, onto which an aqueous suspension of clay material or the like is fed, preferably under pressure.

The water of the suspension, preferably aided by applied pressure, filters through the impression surface whereas the solid particles, having greater dimensions than the pores, are intercepted by the surface itself; consequently a layer of wet pasty material deposits on the surface and is left to dry, after which it is extracted from the mould.

The material used to construct those mould elements presenting the impression surfaces is therefore a porous material which enables the water to filter from the impression cavity through the body of the mould. The most traditional material is plaster-based; however recently a technology has been developed based on moulds constructed with synthetic resin of adequate porosity characteristics, which present the advantage of greater robustness and longer life, and also enable shorter forming cycles to be achieved.

An object of this invention is to improve the drainage systems provided inside moulding elements for facilitating and accelerating, during the formation of the article, the evacuation of the fluid in which the solid material particles are suspended.

DISCLOSURE OF THE INVENTION

This and other objects are attained by this invention as characterised in the claims.

The invention is based on the fact that the drainage system for the slip fluid comprises a thin porous chamber in the form of a plate which is incorporated into the body of the mould element itself, is disposed within the range of drainage action of the impression surface, and has a degree of porosity greater than that part of the body defined between said thin chamber and the impression surface, and at least one evacuation channel connected to said thin chamber to evacuate the drained fluid collected by the chamber.

The method for manufacturing the mould element is based on the fact that during the formation of the body of the mould element, a thin plate is incorporated into the fluid material mass forming the body of the mould element, said plate giving rise to said chamber.

The advantage provided by the invention is that the drainage system is of relatively low construction cost, in that the manufacture of the mould element and the drainage system:

- is relatively simple, to the point of not requiring specialized personnel or complex equipment;
- is economical in that it does not require particularly costly materials.

Moreover the drainage system obtained is extremely efficient and regular, and is suitable for operation with different shapes, both simple and complex.

The invention is described in detail hereinafter with the aid of the accompanying figures, in which.

Figure 1A:
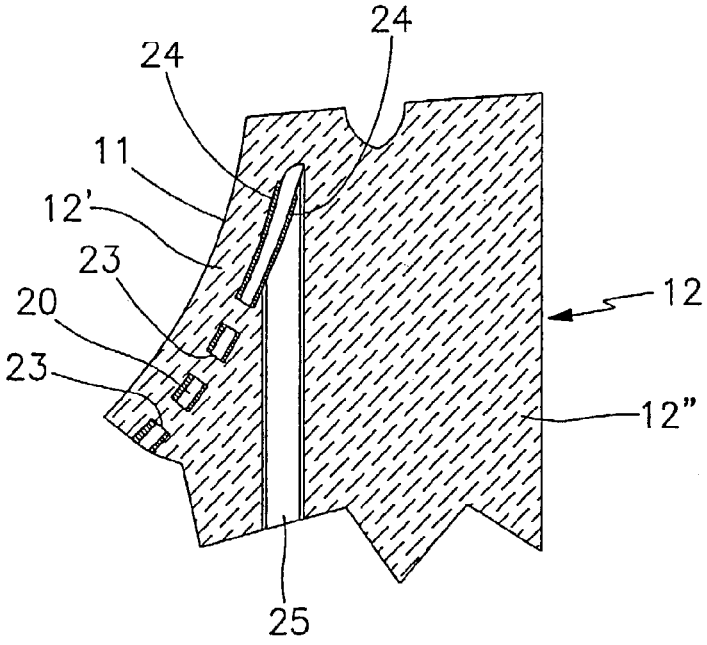
FIG. 1A is an enlarged detail of FIG. 1.
Figure 1:
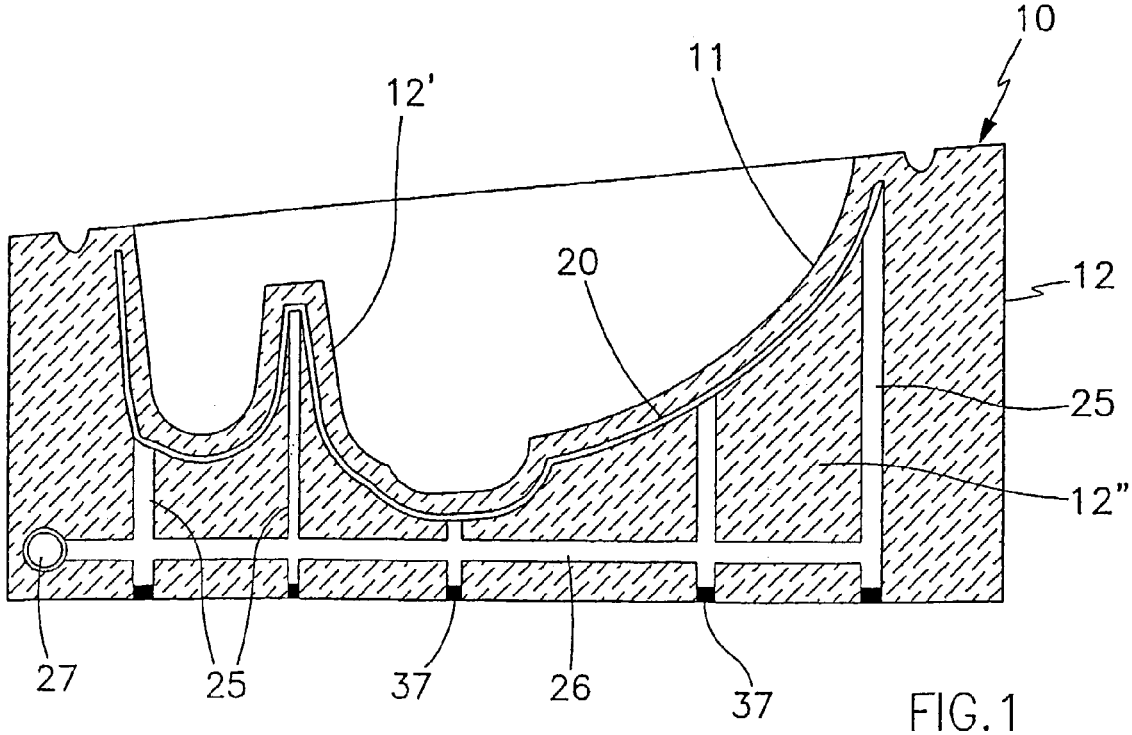
FIG. 1 is a longitudinal section through a mould element for the manufacture of a sanitary appliance, according to the invention.

The mould element shown in FIG. 1 (indicated overall by 10) is a mould for forming a sanitary appliance, in particular a wash-basin, and presents an impression surface 11 suitable for forming the lower surface of the wash-basin.

It is however apparent that the invention can concern a different element of the same mould, or a mould for forming another different article. The impression surface 11 is provided on a body 12 and is permeable and porous; a controlled-thickness layer of clay material is deposited on it during the forming of the article (sanitary appliance, crockery, etc.), following the aforesaid drainage, through the said surface 11, of the fluid (water) in which the particles of clay material are suspended.

According to the invention, a drainage system for said fluid is provided comprising a thin chamber 20, in the form of a plate, incorporated into the body 12 of the mould element 10 and positioned within the range of action of the drainage which takes place through the impression surface 11.

In particular, said thin chamber 20 is disposed substantially parallel to the impression surface 11 at a relatively short distance therefrom which is constant at all its points, its surface area preferably covering the entire impression surface 11. The thin chamber divides the body 12 into a front part 12' defined between the impression surface 11 and the chamber 20, and a rear part 12" positioned to the rear of the chamber 20.

The material forming the impression surface 11, i.e. the front part 12' of the body 12, is a finely porous material, whereas the chamber 20 has a much greater degree of porosity than said part 12'; its porosity is of open intercommunicating type.

The porosity of the remaining part 12" of the body 12, i.e. that lying to the rear of the chamber 20, is indifferent to drainage, hence its constituent material can be the same as the part 12' or different.

The thin chamber 20 possesses a plurality of through holes (i.e. which pass through the plate from one side to the other), perpendicular to the chamber faces, to be filled with the material forming the body 12 of the mould element; by way of these holes, this material hence forms connection bridges between the part 12' and that part of the body 12 to the rear of the chamber 20.

The evacuation system also comprises one or (preferably) a plurality of evacuation channels 25 connected to the thin chamber 20 to evacuate the drainage fluid connected by the chamber 20.

Said channels 25 are connected, downstream, to a collection duct 26 communicating with an exit 27 which leads the drained fluid to the outside of the body 12.

By virtue of the invention, within the body 12 of each mould element an effective drainage system is hence formed in which the thin chamber 20 is the most important component in that it acts as the externally communicating, virtually hollow collection chamber of such a surface area as to influence the entire impression surface 11, and within which the drained fluid is collected and moves with ease and rapidity. The two parts 12' and 12" of the body 12 mutually communicate via the holes 23 and render the body 12, and in particular its front part 12', sufficiently resistant to mechanical stresses.

By virtue to its closeness to the impression surface 11, the fluid which drains through this surface reaches the collection chamber defined by the chamber 20 with relative ease and rapidity, and from here can be quickly evacuated. Suction can also be effectively applied via the chamber 20 to accelerate the drainage action through the surface 11. Fluids can also be fed through the chamber 20 in the opposite direction to the drainage direction, i.e. towards the impression surface 11, in order to facilitate the detachment of the articles formed on the surface 11, or to wash the surface 11 and the front part 12' of the body 12.

The thickness of the chamber 20 varies from about 1 to 25 mm.

With the manufacturing method of the invention, during the forming of the body 12 of the mould element a thin plate, already provided with said plurality of through holes 23, is incorporated into the fluid mass of material forming the mould element body 12, to give rise, by virtue of its volume, to said thin chamber 20.

According to a first procedure for implementing the manufacturing method, the plate incorporated into the fluid mass of material forming the body of the mould element is a porous plate 21 having a greater degree of porosity than the front part 12' of the body of the mould element, and is left permanently within the body 12 of the mould element.

Various materials can be used to form the porous plate. 21; in practice the following materials have been identified: a spongy resin, an expanded plastic with intercommunicating open pores, a permeable fabric, or a synthetic material of the type used for air/water/oil filters.

The porous plate is prepared by associating protection means therewith to prevent the material forming the body 12 from penetrating into the pores of the plate during the forming of the body 12 of the mould element.

According to a first manner of implementing this technique, said protection means comprise a protection substance which completely impregnates the porous plate 21, fills its pore cavities and prevents the material forming the body 12 of the mould element from penetrating into these pores, the protection substance then being evacuated form the porous plate after the mould element has been formed. Alternatively, protection film, sheets or strips formed with said substance can be used, applied to the two faces of the plate.

Said protection substance can be a substance which gels at low temperature (for example less than 30 degrees centigrade) and becomes fluid again at higher temperature. In this case it is evacuated from the porous plate 21 after the mould element has been formed, by heating it, for example by feeding a hot fluid into the interior of the plate 21.

For example, said substance can be:

a mixture of polyvalent alcohols;

an alcoholic solution of fatty acid salts;

an aqueous solution of fatty acid salts;

a mixture of aqueous and alcoholic solutions of fatty acid salts;

an aqueous solution of water-soluble polymers;

a mixture of the aforelisted substances.

Alternatively, said protection substance can be a water-soluble substance which is subsequently evacuated from the porous plate, after the mould element has been formed, by feeding water into the porous plate 21. For example, film, sheets or strips based on biodegradable plastic materials or water-soluble polymers can be used, applied to the two faces of the plate.

According to a second manner of implementing this technique, a thin protection foil (not shown in the figures) with through holes mating with the through holes 23 of the porous plate 21 is associated with at least one face, and preferably with both faces, of the porous plate to prevent the material forming the body 12 of the mould element from penetrating into the pores of the porous plate 21 by virtue of possessing a lesser porosity,. virtually equal to that of the front part 12' of the body 12.

According to a second procedure for implementing the manufacturing method, the plate 21 incorporated into the fluid mass of material forming the body 12 of the mould element is a sufficiently solid and resistant plate 21 formed from water-soluble material which, after being incorporated into the body 12 of the mould element, is dissolved and removed by passage of water. In this case the volume previously occupied by the plate 21 gives rise to said thin chamber 20.

Preferably, all the described types of plate 21 are provided with said through holes 23, through which the two parts 12' and 12" of the body 12 mutually communicate to hence secure the plate 21 to the body 12 and render the body 12, and in particular its front part 12', sufficiently resistant to mechanical stresses.

With the plate 21 there can also be associated a thin reinforcement which is sufficiently rigid to permanently give it the required geometrical shape, for example a reinforcement 24 of mesh type.

Figure 2A:
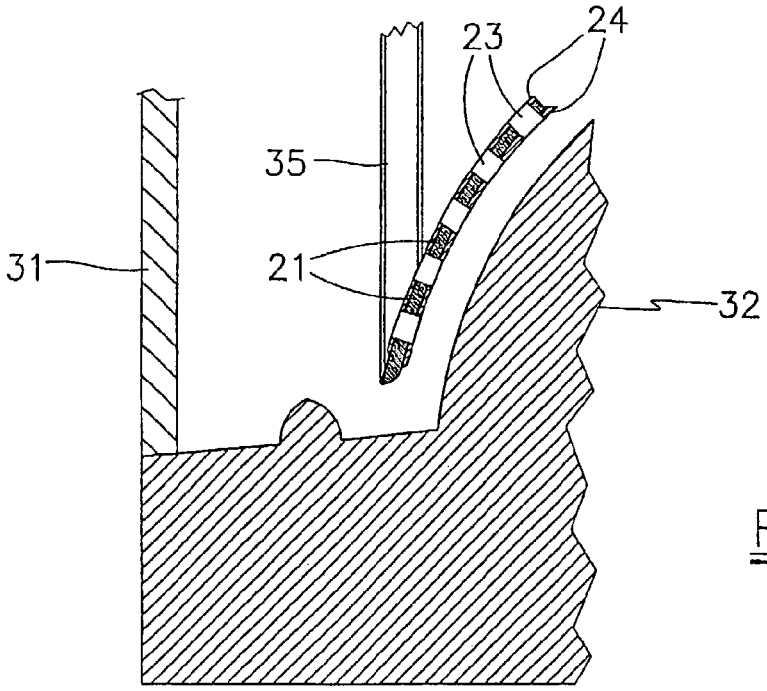
FIG. 2A is an enlarged detail of FIG. 2.
Figure 2:
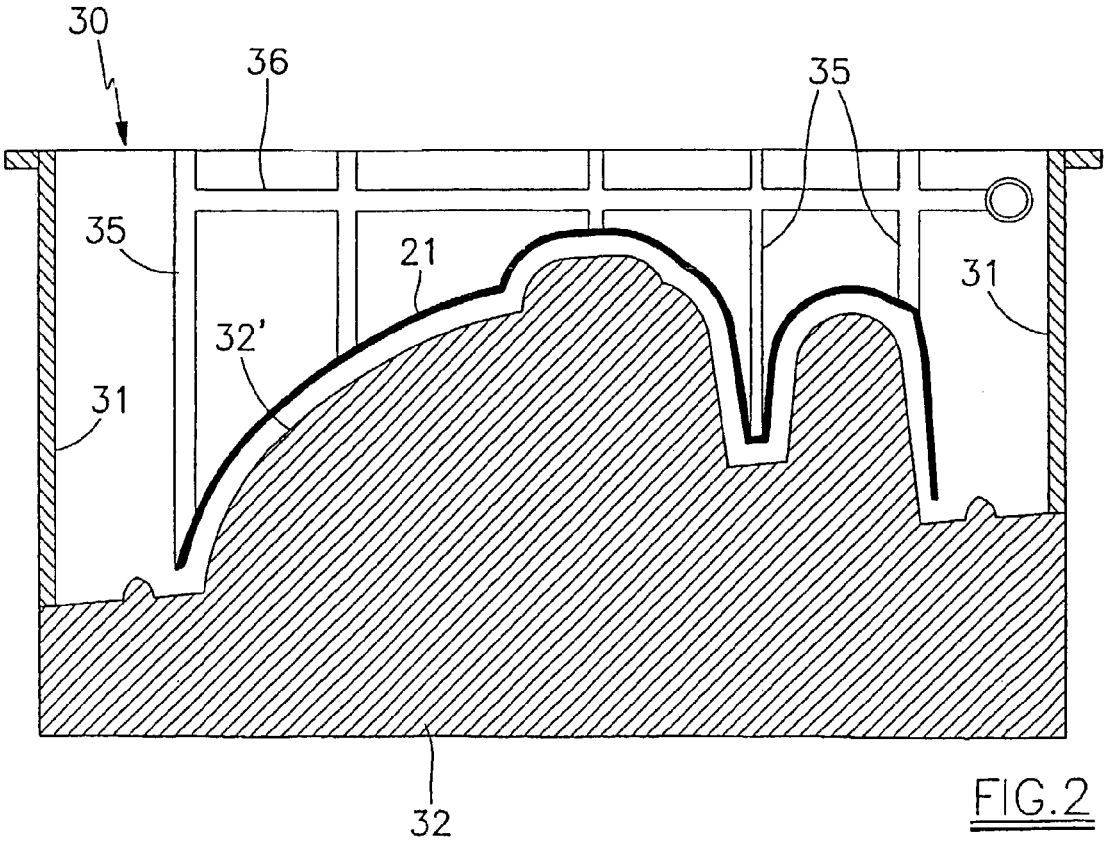
FIG. 2 is a longitudinal section through a form for constructing the mould element of FIG. 1.
Figure 3:
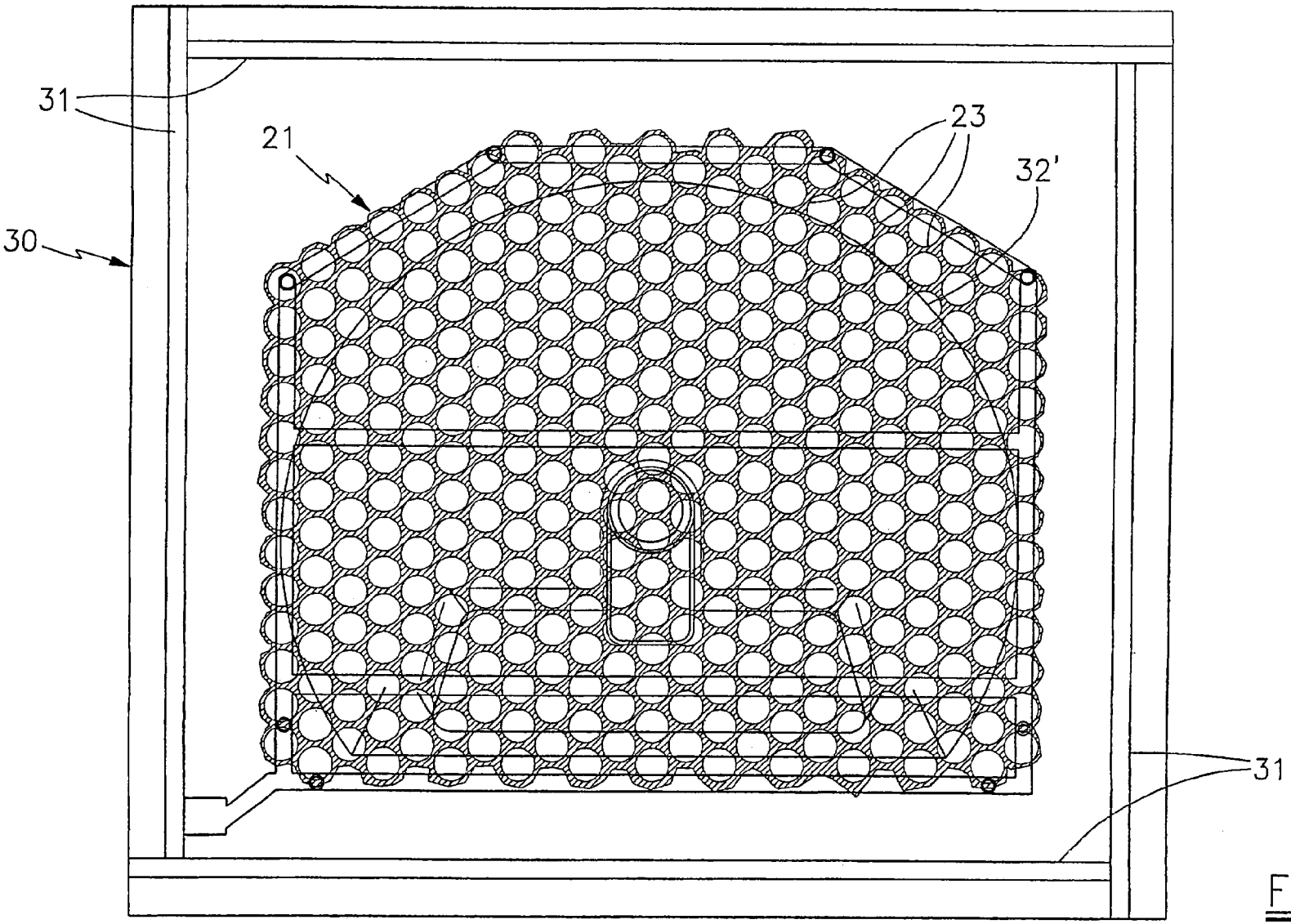
FIG. 3 is a plan view of FIG. 2 from above.

FIG. 2 shows a possible form 30 for constructing the mould element 30 in accordance with any one of the aforedescribed manufacturing methods. The form 30 comprises an outer casing closed on its sides by lateral walls 31 and lowerly by a profiled base 32, the upper surface 32' of which has the same shape as the surface of the article to be formed with the mould element 10. In particular, in the example illustrated in the figures, the surface 32' has the same shape as the lower surface of a wash-basin.

The volume enclosed by the casing above the surface 32' is intended to be filled with suitable material, such as plaster or synthetic resin, to produce the body 12 of the mould element 10.

The thin plate 21, the shape of which reproduces that of the upper surface 32', is initially arranged within said volume a short distance therefrom. To give the plate 21 the required geometrical shape, as stated heretofore a reinforcement formed from two meshes 24 sufficiently rigid to maintain the shape is associated with it.

The meshes 24 and the plate 21 are supported by a plurality of vertical tubes 35, to which other horizontal tubes 36 are joined at the highest part. After the material for forming the mould has been inserted into the form, the tubes 35 and 36 also remain incorporated into the body 12, their inner bores giving rise to the channels 25 and 26 respectively. The upper ends of the channels 25 are finally closed with plugs 37 to create a single outlet for the fluid, via the exit 27.

Numerous modifications of a practical and applicational nature can be made to the invention, but without leaving the scope of the inventive idea as claimed below.

What is claimed is:

1. A moulding element for forming articles by slip casting with clay or similar materials, having at least one permeable, porous impression surface on which the clay slip is deposited, a drainage system for the slip fluid, having a relatively thin porous chamber formed by a thin hollow plate which is incorporated into a body of the mould element itself, said thin porous chamber being disposed within the range of drainage action of the impression surface, and having a degree of porosity greater than a front part of the body defined between said thin porous chamber and the impression surface, said hollow plate forming said thin porous chamber having a plurality of through holes which are filled by a material forming the body of the mould element which joins together the front part of the body to a rear part of the body and produces a hollow portion in the hollow plate outside the circumference of the material filled in the through hole;

evacuation means being provided connected to said hollow portion produced by the material filled in the through holes to evacuate the drained fluid collected by the chamber.

2. A mould element as claimed in claim 1, wherein said hollow plate forming said thin porous chamber is disposed substantially parallel to the impression surface and at a relatively short distance therefrom.

3. A method for manufacturing a mould element as claimed in claim 1, wherein during the forming of the body of the mould element, when the thin hollow plate is incorporated into the fluid mass of material forming the body, the volume occupied by said plate gives rise to said thin porous chamber;

said thin plate being provided with a plurality of through holes which are filled with the material forming the body of the mould element.

4. A method for manufacturing a mould element as claimed in claim 3, wherein the thin hollow plate which is incorporated into the fluid mass of material forming the body of the mould element is a porous plate, which has a degree of porosity greater than the front part of the body of the mould element and is left permanently within the body of the mould element.

5. A method for manufacturing a mould element as claimed in claim 4, wherein said porous plate is prepared by associating protection means therewith to prevent the material forming the body of the mould element from penetrating into the pores of the porous plate during the formation of the body of the mould element.

6. A method as claimed in claim 5, wherein the porous plate is impregnated with a protection substance which fills the pore cavities of the plate and prevents the material forming the body of the mould element from penetrating into said pores, said protection substance being subsequently extracted from the porous plate after the mould element has been formed.

7. A method as claimed in claim 5, wherein the porous plate is protected by protection film, sheets or strips, formed from a protection substance, which are applied to the two faces of the plate, said protection substance being subsequently evacuated from the porous plate after the mould element has been formed.

8. A method as claimed in claim 6 or 7, wherein said protection substance is a substance which gels at low temperature and again becomes fluid at higher temperature, said substance being evacuated from the porous plate by heating it, after the mould element has been formed.

9. A method as claimed in claim 6 or 7, wherein said protection substance is a water-soluble substance, said substance being evacuated from the porous plate by feeding water through the porous plate after the mould has been formed.

10. A method as claimed in claim 5, wherein a thin protection foil with through holes mating with the through holes of the porous plate is associated with at least one face of the porous plate to prevent the material forming the body of the mould element from penetrating into the pores of the porous plate, said foil having a porosity virtually equal to that of the front part of the body of the mould element.

11. A method as claimed in claim 3, wherein a reinforcement sufficiently rigid to give the plate the required geometrical shape is associated with said thin plate.

12. A moulding element for forming articles by slip fluid casting with clay or similar materials, comprising at least one permeable, porous impression surface on which the slip fluid is deposited;

a drainage system for the slip fluid incorporated into a body of the mould element itself, said drainage system being disposed within the range of drainage action of the impression surface, and having a relatively thin and empty chamber formed by a thin plate;

evacuation means being provided connected to said thin empty chamber to evacuate the drained fluid collected by the chamber.

13. A mould element as claimed in claim 12, wherein said thin chamber is disposed substantially parallel to the impression surface and at a relatively short distance therefrom.

14. A mould element as claimed in claim 13, wherein said thin chamber possesses a plurality of through holes filled by the material forming the body of the mould element which joins together a front part of the body to a rear part of the body.

15. A method for manufacturing a mould element as claimed in claim 14, wherein said thin plate being formed from solid water-soluble material which, after being incorporated into the body of the mould element, is dissolved and removed by passage of water to form said empty chamber.

16. A moulding element for forming articles by slip fluid casting with clay or similar materials, comprising at least one permeable, porous impression surface on which the clay slip is deposited;

a drainage system for the slip fluid incorporated into a body of the mould element itself, said drainage system being disposed within the range of drainage action of the impression surface, and including a relatively thin empty chamber formed by a plate;

the thin empty chamber dividing the body of the mould element into a front part defined between the impression surface and the thin chamber and a rear part positioned to the rear of the thin empty chamber, the material forming the rear part of the body being the same as the material forming the front part of the body.

* * * * *